United States Patent [19]

Larsson et al.

[11] Patent Number: 4,936,883

[45] Date of Patent: Jun. 26, 1990

[54] ARRANGEMENT IN A SUCTION CLEANER

[75] Inventors: Anders E. C. Larsson, Stockholm; Joakim A. Svanberg, Johanneshov; Lars G. Kilström, Täby; Lars G. Tuvin, Knivsta, all of Sweden

[73] Assignee: Aktiebolaget Electrolux, Stockholm, Sweden

[21] Appl. No.: 333,441

[22] Filed: Apr. 5, 1989

[30] Foreign Application Priority Data

Apr. 6, 1988 [SE] Sweden ..... 8801268

[51] Int. Cl.[5] ..... B01D 46/02

[52] U.S. Cl. ..... 55/374; 285/7; 285/227

[58] Field of Search ..... 55/302, 374, 375, 378; 285/7, 227

[56] References Cited

U.S. PATENT DOCUMENTS

| | | | |
|---|---|---|---|
| 2,070,674 | 2/1937 | Muenter | 55/367 |
| 3,167,415 | 1/1965 | Edwards | 55/302 |
| 3,423,907 | 1/1969 | Hughes | 55/367 |
| 4,591,369 | 5/1986 | Stewart et al. | 55/374 |

*Primary Examiner*—Bernard Nozick

*Attorney, Agent, or Firm*—Pearne, Gordon, McCoy & Granger

[57] ABSTRACT

In a suction cleaner comprising a housing (10) with a disposable filter bag (13) a movable tube piece (17) is provided which is adapted to enter the inlet opening (14*a*) of the filter bag. According to the invention, the tube piece (17) is provided with a control means actuatable by a pressure difference, preferably the difference between atmospheric pressure and the underpressure in the suction cleaner housing.

3 Claims, 2 Drawing Sheets

ARRANGEMENT IN A SUCTION CLEANER

The present invention relates to an arrangement in a suction cleaner comprising a housing with a suction fan and a disposable filter bag, the arrangement comprising a movable tube piece connected to the inlet of the housing and adapted to enter the inlet opening of the filter bag.

In suction cleaners of this type it is important that a tight connection is provided between the filter bag and the inlet. If this is not the case dust particles may by-pass the filter bag on its outside and be carried to the motor chamber which, if it comes to the worst, may lead to a motor breakdown. It is also important that the filter bag can be easily replaced. This can be obtained by providing the inlet of the suction cleaner in a cover which can be opened and is provided with a tube piece penetrating the opening of the filter bag when the cover is closed.

The object of the present invention is to provide a suction cleaner in which a perfect scaling between the tube piece and the filter bag is obtained without arranging the inlet in a movable cover. This has been obtained by means of an arrangement of the kind mentioned in the introduction which according to the invention is characterized in that the tube piece is provided with a control means which is actuatable by a pressure difference created by the suction fan.

Figure 1:
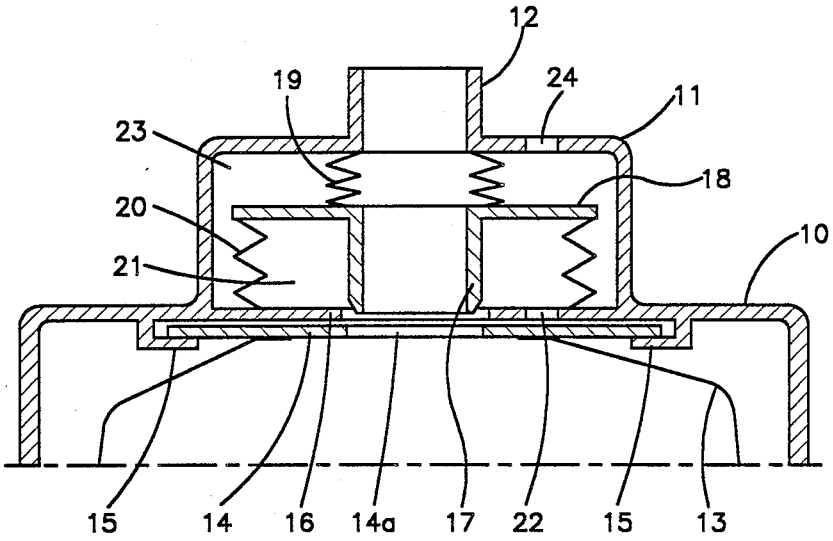
Figure 2:
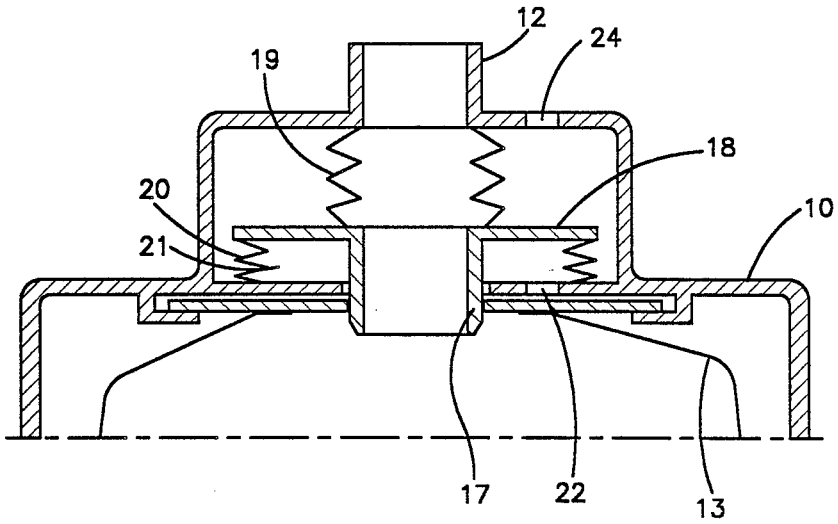
Figure 3:
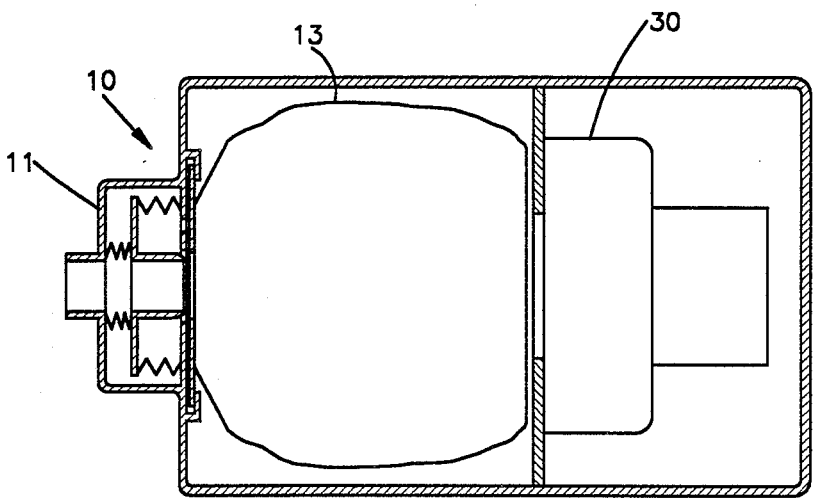

The invention will be described in more detail in the following with reference to the accompanying drawing on which FIGS. 1 and 2 illustrate longitudinal sections of the arrangement according to the invention in two different positions, and FIG. 3 illustrates a longitudinal section of a suction cleaner including the invention.

The drawing illustrates a portion of a suction cleaner housing 10 having a protruding portion 11 with an inlet 12 for dust laden air. Inside the housing 10 is provided a disposable filter bag 13 having a supporting plate member 14 of cardboard or the like. The plate member 14 has an inlet opening 14*a* and is inserted into holder means 15 on both sides in the conventional manner. Adjacent the plate member 14 is a partition 16 which is part of the suction cleaner housing and defines a chamber within the protruding portion 11 in which is provided a movable tube piece 17 connected to an annular disc 18. Between the disc 18 and the inlet 12 is provided a first, small bellows 19 which together with the tube piece 17 forms a suction passage between the inlet and the filter bag 13.

Between the periphery of the disc 18 and the partition 16 is provided a second, larger bellows 20 enclosing a chamber 21 which is connected to the interior of the suction cleaner via an opening 22. Outside both bellows 19 and 20 is formed a chamber 23 connected to the atmosphere via an opening 24.

In the position of the arrangement shown in FIG. 1 the suction cleaner is shut off and atmospheric pressure is prevailing in both chambers 21 and 23. In this position the filter bag may be replaced. When the suction fan 30 (See FIG. 3) of the suction cleaner is started a subatmospheric pressure is created in the cleaner housing, and this pressure is transmitted to the chamber 21 via the opening 22. In the chamber 23, however, atmospheric pressure is still prevailing whereby the disc 18 due to the pressure difference acting thereon is displaced together with the tube piece 17 to the position shown in FIG. 2. During this displacement the tube piece 17 enters the opening 14*a* of the supporting plate 14 of the filter bag. The opening 14 is preferably provided with a not shown rubber sealing whereby a tight connection is obtained.

When the suction fan is shut off the underpressure in the suction cleaner housing as well as in the chamber 21 is replaced by atmospheric pressure whereby the pressure difference across the disc 18 ceases to exist. The arrangement then returns to the position shown in FIG. 1 due to resilient action of the bellows 19 and 20.

In the described embodiment atmospheric pressure is used to obtain adjustment of the movable tube piece 17. However, it is also within the framework of the invention to utilize a higher or lower pressure which must nevertheless be higher than the underpressure in the suction cleaner housing created by the suction fan.

We claim:

1. A suction cleaner comprising a housing (10) within which is mounted a suction fan (30), a disposable filter bag (13) mounted within the housing, and a movable tube piece (17) connected to an inlet (12) of the housing and being movable to enter an inlet opening (14*a*) of the filter bag, wherein the tube piece (17) movement is provided by a control means connected to the tube piece which is actuatable by a pressure difference created by the suction fan.

2. A suction cleaner according to claim 1, wherein the control means is actuatable by the pressure difference between atmospheric pressure and the underpressure in the suction cleaner housing when the suction fan is operating.

3. A suction cleaner according to claim 1 or 2, wherein the control means comprises a disc (18) connected to said tube piece (17) said disc (18) being connected to the inlet (12) of the suction cleaner by means of a first, small bellows (19) and to the suction cleaner housing by means of a second, larger bellows (20), said bellows being actuated via an opening (22) extending between the interior volume of the larger bellows and an inlet of the suction fan.

* * * * *